United States Patent [19]

Glotfelter

[11] 4,393,789

[45] Jul. 19, 1983

[54] HIGH SECURITY TRANSACTION DRAWER

[76] Inventor: Herman E. Glotfelter, 4618 N. Post Rd., Indianapolis, Ind. 46226

[21] Appl. No.: 228,077

[22] Filed: Jan. 26, 1981

[51] Int. Cl.[3] ..... E06B 7/32

[52] U.S. Cl. ..... 109/19

[58] Field of Search ..... 109/19

[56] References Cited

U.S. PATENT DOCUMENTS 3,145,918 8/1964 Higgins et al. ..... 109/19

FOREIGN PATENT DOCUMENTS 1021226 2/1953 France ..... 109/19

*Primary Examiner*—Robert Peshock

*Attorney, Agent, or Firm*—Harvey B. Jacobson

[57] ABSTRACT

Support structure is provided for mounting in operative association with a horizontal opening formed through an upstanding partition and a transaction drawer defining an upwardly opening compartment is supported from the support structure for shifting through the opening between first and second positions with the compartment of the drawer opening upwardly on first and second sides of the partition. A security panel is shiftably supported from the drawer for movement between closed and open positions, closing and opening, respectively, the compartment from above and shifting structure is operatively connected between the panel and the support structure operative to shift the panel to the open position when the drawer is in the first and second positions, and to shift the panel to the closed position during the major portion of shifting of the drawer from one open position toward the other open position. The panel is constructed of transparent bullet resistant material and the end of the drawer facing in the direction toward which the drawer is moved to the first position includes a barrier therein constructed of a second bullet resistant material.

9 Claims, 9 Drawing Figures

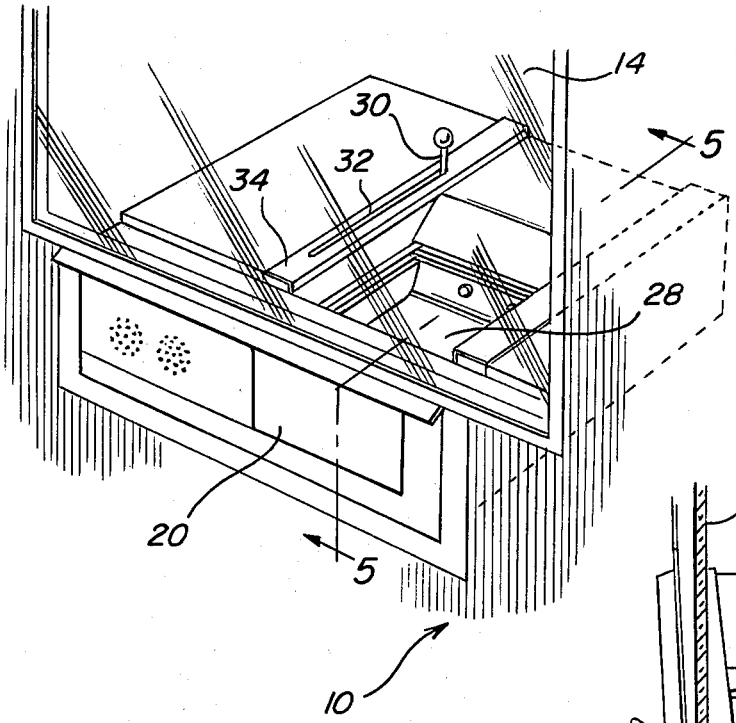
Fig. 1
Fig. 2
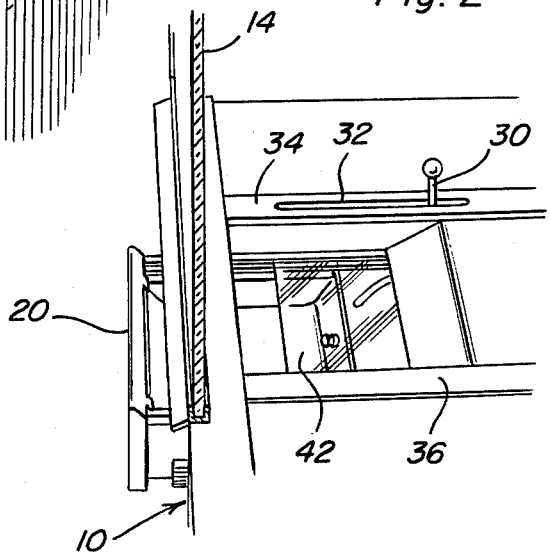
Fig. 3
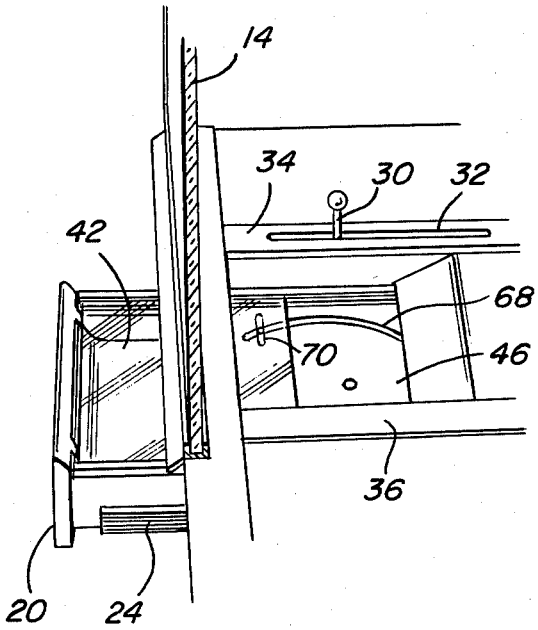
Fig. 4
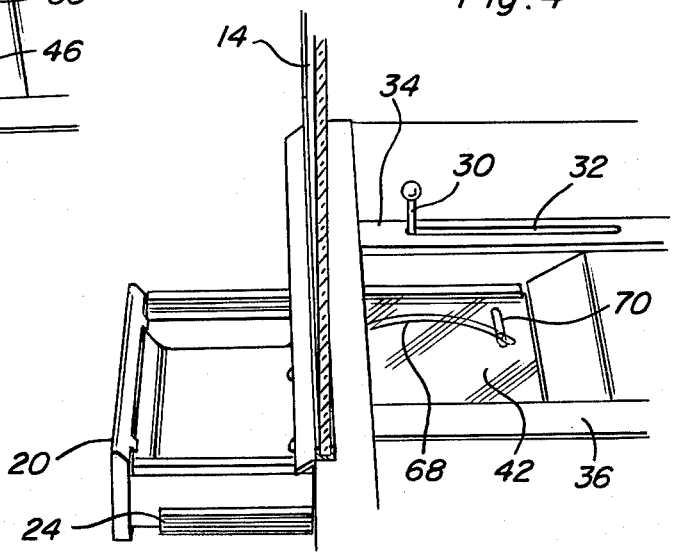

HIGH SECURITY TRANSACTION DRAWER

BACKGROUND OF THE INVENTION

Various businesses, such as drive-in banks and "gas and go" gas stations, utilize transaction drawers whereby a teller or attendant on a first side of a partition may shift a drawer through the partition to an open position on the second side of the partition and then retract the drawer back through the partition through the first side thereof. However, most transaction drawers must be of considerable size and it is possible for a person on the second side of the partition to insert his hand, and a hand gun supported therefrom, into the drawer while the drawer is approximately halfway between its limit positions of movement and to aim the hand gun at a person disposed on the opposite side of the associated partition. In this manner, the transaction drawer ceases to function in a security manner. Accordingly, a need exists for a drawer cover which will prevent breach of drawer security in this manner.

Examples of various forms of security transaction drawers and other similar structures heretofore known are disclosed in U.S. Pat. Nos. 2,730,053, 3,145,918, 3,390,833, 4,119,269 and 4,190,004. However, these previously known forms of security drawers do not include structure providing a drawer of adequate size for various transactions and yet which also function to provide the desired high security.

BRIEF DESCRIPTION OF THE INVENTION

The security transaction drawer of the instant invention is constructed in a manner to afford a high degree of security and includes a drawer which may be shifted through an associated partition from a first side of the partition to a second side of the partition and with the drawer defining a cavity which opens upwardly, substantially throughout its entire plan area, from both the first and second sides of the partition. The drawer, however, includes a slidable closure panel shiftable between closed and open positions closing and opening the drawer cavity from above and the cover is operatively connected between the drawer and the drawer support structure from which the drawer is slidably supported in a manner such that the panel is shifted to positions substantially fully opening the cavity of the drawer to access thereto from above when the drawer is disposed in each of its limit positions of movement. However, movement of the drawer no more than one quarter of the distance from each limit position toward the other limit position is operative to slide the cover panel to the closed position and to maintain the cover panel in the closed position until final movement of the drawer to the remote limit position.

The main object of this invention is to provide a transaction drawer offering a high degree of security.

Another object of this invention is to provide a transaction drawer in accordance with the preceding objects and which may be used as a replacement for existing transaction drawers of lower security merely by the removal of the lower security drawer and installation of the high security drawer assembly in its place.

A further object of this inventio is to provide a high security transaction drawer which will assure security sufficient to deter substantially all attempts to breach the security thereof.

A final object of this invention to be specifically enumerated herein is to provide a high security transaction drawer in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a typical installation of the high security transaction drawer of the instant invention;

FIG. 2 is a fragmentary perspective view of the assemblage illustrated in FIG. 1 and with the drawer in an initial open position;

FIG. 3 is a perspective view similar to FIG. 2 but illustrating the drawer in an intermediate open position and with the cover panel thereof in a closed position;

FIG. 4 is a perspective view, similar to FIG. 2, but illustrating the drawer in a fully open position and with the cover panel thereof in an open position;

DETAILED DESCRIPTION OF THE INVENTION

Figure 5:
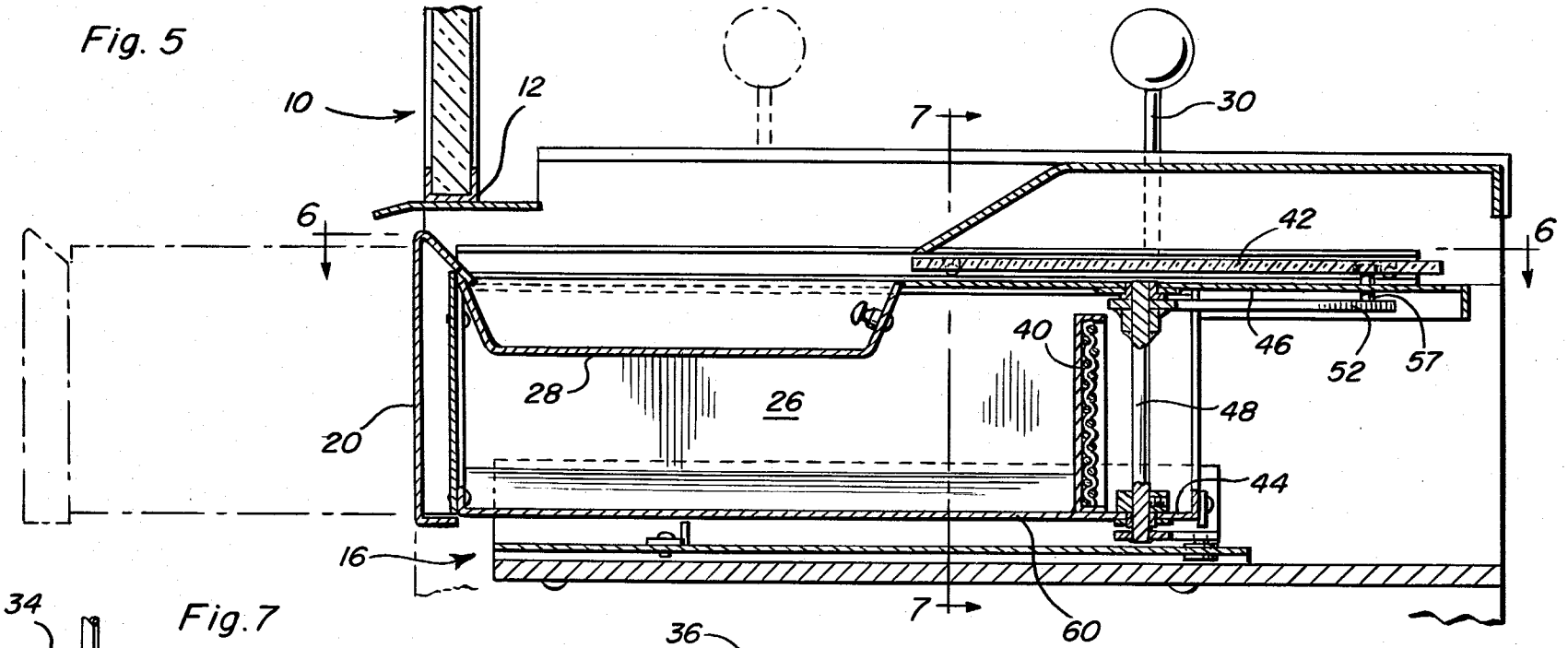
FIG. 5 is an enlarged fragmentary vertical sectional view taken substantially upon the plane indicated by the section line 5—5 of FIG. 1.
Figure 8:
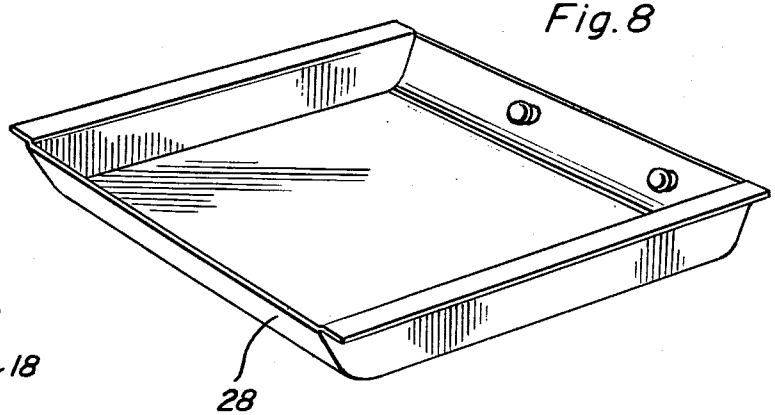
FIG. 8 is a perspective view of the removable tray portion of the drawer.

Referring now more specifically to the drawings, the numeral 10 generally designates a partition having a drawer opening 12 formed therein. The lower portion of the partition 10 is opaque and the upper portion of the partition includes a bullet resistant window 14 mounted therein.

The transaction drawer of the instant invention is referred to in general by the reference numeral 16 and includes stationary support structure 18 mounted within the opening 12 and a drawer 20 supported from the support structure 18 by opposite side guide structures 22 and 24 mounted on the support structure 18 and the drawer 20.

The drawer 20 defines an upwardly opening cavity 26 therein and the upper portion of the cavity 26 removably receives a shallow tray 28 for use when the full depth of the drawer cavity 26 is not needed.

An upstanding operating handle 30 is supported from the rear portion of the drawer 20 and is slidably received through a slot 32 formed in one upper side mounting portion 34 of the support structure 18. The support structure includes a second opposite side upper mounting portion 36 and the mounting portions 34 and 36 support the support structure 18 from the marginal portions of a counter structure 38 disposed on the inner side of the partition 10.

The drawer 20 is shiftable between a first position, such as that illustrated in FIGS. 1 and 5 of the drawings, disposed on the inner or first side of the partition and a second position illustrated in FIG. 4 disposed on the second or outer side of the partition 10.

The end of the drawer which is advanced toward the first position thereof includes a bullet resistant transverse end wall 40 and the upper portion of the drawer 20 slidably mounts a transparent bullet resistant security or cover panel 42 therefrom. The cover panel 42 is mounted on the drawer 20 for movement therewith between the first and second positions of the drawer, but is slidable relative to the drawer 20 between the open position thereof illustrated in FIG. 5 providing access to the interior of the tray from directly thereabove and a closed position such as that illustrated in FIG. 3 of the drawings with the security panel or cover 42 in a closed position closing the interior of the tray against access from above.

The rear of the drawer 20 includes vertically disposed lower and upper wall portions 44 and 46 from which the lower and upper ends of a vertical control rod 48 are oscillatably supported. The lower end of the control rod includes a horizontal cross head 50 supported therefrom and the upper end of the control rod includes a horizontal operating arm 52 supported therefrom. The opposite ends of the cross head 50 includes dependingly supported horizontal rollers 54 and 56 journaled therefrom, see FIG. 9, and the free end of the operating arm includes an upstanding shaft portion 57 including a roller guide 58 supported therefrom.

The support structure 18 includes a cam plate 60 supported therefrom and the cam plate 60 includes a pair of cam openings 62 and 64 formed therein in which rollers 54 and 56 are received. The drawer 20 is shiftable relative to the cam plate 60 and when the drawer 20 is in the first position thereof disposed on the inner side of the partition 10, such as that illustrated in FIG. 1 of the drawings, the cross head 50 is disposed in the position thereof illustrated in solid lines in FIG. 9. The roller guide 58 carried by the upper end of the shaft portion 57 is slidably received in an arcuate slot 68 formed in the upper wall portion 46 and also in a transverse groove 70 formed in the underside of the cover 42.

Figure 6:
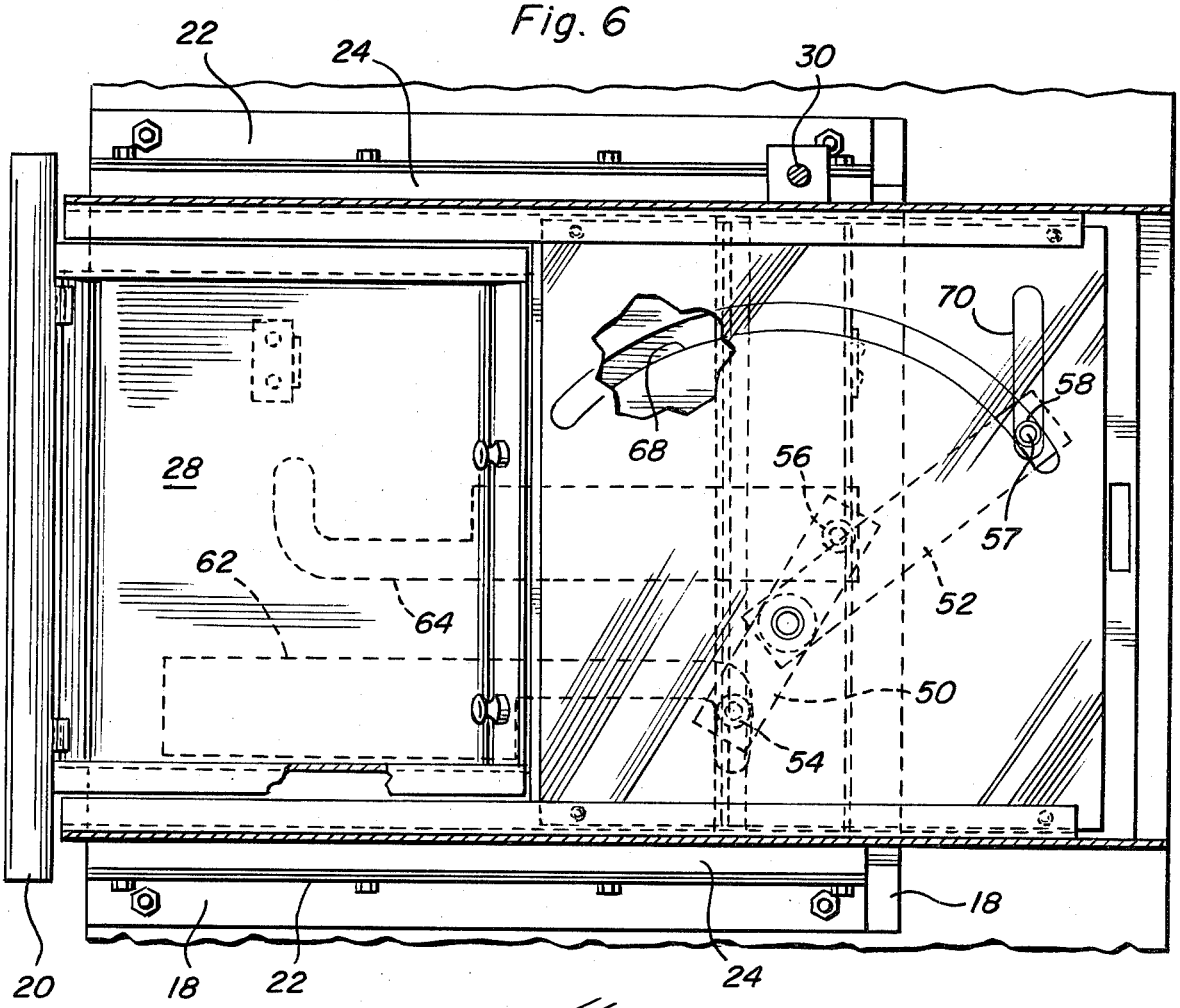
FIG. 6 is a horizontal sectional view taken substantially upon the plane indicated by the section line 6—6 of FIG. 5.
Figure 9:
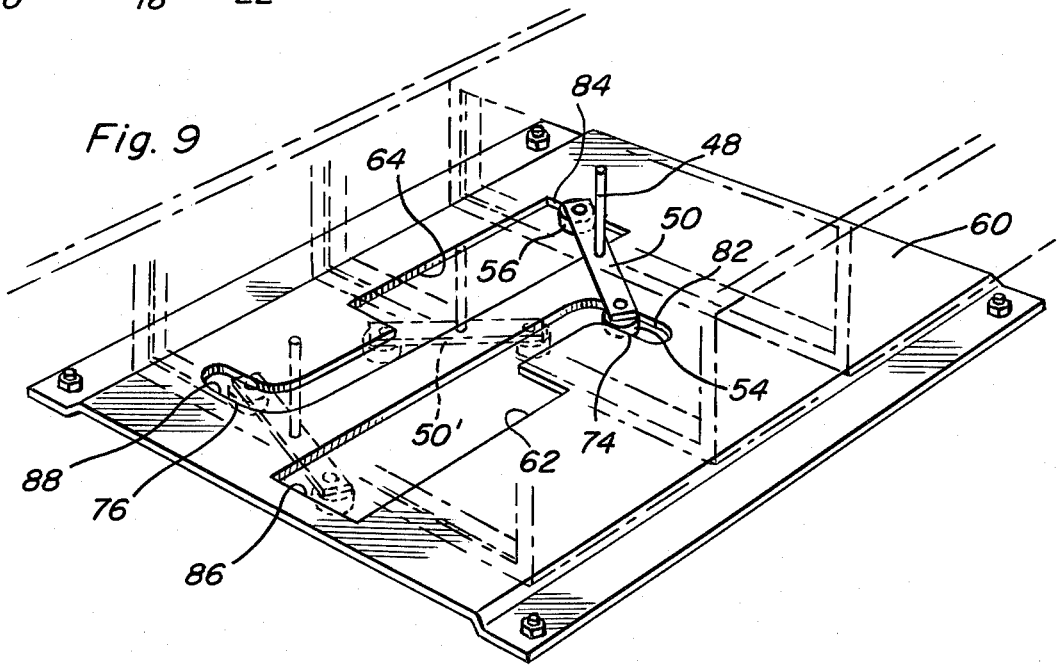
FIG. 9 is a perspective view illustrating the lower portion of the cover panel actuating structure operatively connected between the drawer support structure and the cover panel and with alternate positions of the cover panel actuating structure illustrated in phantom lines.

When the drawer 20 is shifted from the first open position thereof on the inner side of the partition 10 toward the second open position thereof disposed on the outer side of the partition 10, initial movement of the drawer 20 from the first open position to the second open position causes the cross head 50 to swing in a counterclockwise direction as viewed in FIG. 9 of the drawings due to engagement of the roller 54 with the edge 74 of the cam opening 62. As the cam head moves toward the phantom line position 50' thereof illustrated in FIG. 9, it is rotated approximately 90° from the position thereof illustrated in FIG. 6 causing the cover 42 to be rapidly forwardly shifted relative to the drawer 20 to the fully closed position closing the tray 28 against access thereinto from above. Movement of the cover 42 from the open position thereof illustrated in FIG. 1 to the closed position illustrated in FIG. 3 is effected during no more than one quarter of the movement of the drawer from the first open position thereof disposed on the interior of the partition 10 toward the second open position thereof disposed to the exterior of the partition 10. Thereafter, the cross head 50 is maintained in the postion thereof illustrated as at 50' in FIG. 9 throughout the next half movement of the drawer toward the second open position thereof illustrated in FIG. 4 to the exterior of the partition 10 and during final movement of the drawer 20 to the second open position thereof, the roller 56 engages the edge 76 of the cam opening 64 and causes the cross head 50 to be angularly displaced in a clockwise direction as viewed in FIG. 9 of the drawings back toward the original position with the cover 42 in a fully open position. Thus, when the drawer 20 is in either of the full open positions thereof illustrated in FIGS. 1 and 4 of the drawings disposed to the exterior and interior of the partition 10, the cover 42 is in the full open position. However, during no more than the first one-quarter movement of the drawer 20 to the opposite open position, the cover 42 is rapidly shifted to the fully closed position thereof illustrated in FIG. 3 and maintained in that fully closed position until the final one-quarter movement of the drawer 20 to the opposite open position.

In the above manner automatic opening and closing of the cover panel 42 is assured and it is impossible for a person disposed on the exterior of the partition 10 to place the hand in the drawer (either with or without the tray 28 in place) with a hand gun in his hand and gain access to the inside of the partition 10 through the drawer 20.

Although various forms of security drawers are provided with cover panels which may be swung between open and closed positions, such swinging movement presents a hazard leading to possible injury of the operator's fingers and is subject to mechanical failure. However, with the sliding cover 42 of the instant invention, protection of the operator's fingers is substantially assured inasmuch as the cover 42 is retracted and extended from and to the closed position from the rear side of the drawer, most swingable closure panels heretofore provided on transaction drawers swinging between the open and closed positions thereof at the rear side of the associated drawer.

Figure 7:
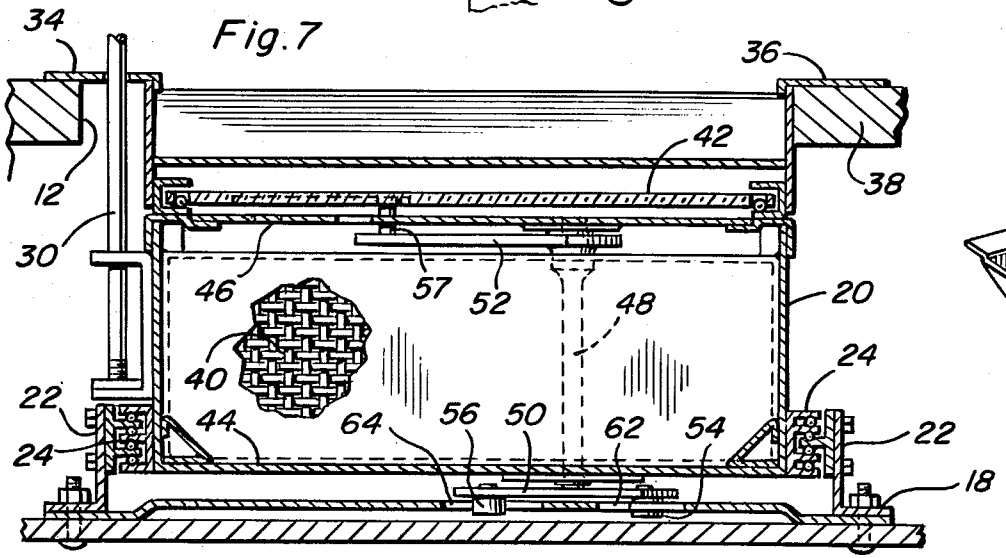
FIG. 7 is a vertical sectional view taken substantially upon the plane indicated by the section line 7—7 of FIG. 5.

The rapidity by which the cover 42 is shifted between the open and closed positions thereof is determined by the spacing of the rollers 54 and 56 along the cross head 50 from the rod 48. In addition, engagement of the rollers 54 and 56 with the edges 82 and 84 of the openings 62 and 64 effectively serve to limit movement of the drawer 20 to the second open position thereof disposed to the exterior of the partition 10 and engagement of the same rollers 54 and 56 with the edges 86 and 88 of the openings 62 and 64 effectively limits movement of the drawer 20 to the first open position thereof to the interior of the partition 10. Also, it will be noted from FIG. 7 of the drawings that the entire support structure 18 for the drawer 20 may be readily mounted within the opening 12 in the counter 38. Thus, the transaction drawer 16 may be used as a ready replacement for existing transaction drawers affording considerably less security.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a partition structure having a horizontal drawer opening formed therethrough, a drawer structure defining an upwardly opening compartment, support means supporting said drawer structure from said partition for shifting of said drawer through said opening between first and second positions with said compartment opening upwardly on first and second sides of said partition, a security panel shiftably supported from said drawer for movement between closed and open positions closing and opening, respectively, said compartment from above, and security panel shifting means operatively connected between said panel and said support means for automatically shifting said panel to said open position responsive to said drawer being shifted to said first position, automatic shifting of said panel to said closed position responsive to initial shifting of said drawer from said first position toward said second position and automatic shifting of said panel back to said open position responsive to final movement of said drawer to said second position.

2. The combination of claim 1 wherein said panel is slidably supported from said drawer for rectilinear movement between said closed and open positions.

3. The combination of claim 2 wherein said shifting means includes connecting means operative to automatically shift said panel from said open position to said closed position during no more than the initial one quarter movement of said drawer from said first position toward said second position, retain said panel in said closed position during at least the next one-half movement of said drawer toward said second position and to automatically shift said panel from the closed position to the open position during no more than the last one-quarter of said drawer to said second position.

4. The combination of claim 1 wherein said panel is constructed of bullet resistant material.

5. The combination of claim 4 wherein the end of said drawer advanced toward the first position includes a barrier therein constructed of a second bullet resistant material.

6. The combination of claim 5 wherein the bullet resistant panel is constructed of transparent material.

7. The combination of claim 3 wherein said connecting means includes a connecting member operably supported from said drawer and including a pin and slot connection with said cover and a pin and slot connection with said support means.

8. The combination of claim 1 wherein said drawer includes a shallow upwardly opening tray removably supported in the upper portion of said cavity and removable from said drawer when the latter is in said first position.

9. The combination of claim 1 wherein said shifting means includes connecting means operative to shift said panel from said open position to said closed position during no more than the initial one quarter movement of said drawer from said first position toward said second position, retain said panel in said closed position during at least the next one-half movement of said drawer toward said second position and to shift said panel from the closed position to the open position during no more than the last one-quarter of said drawer to said second position.

* * * * *